US010010190B2

(12) United States Patent
Eigenmann et al.

(10) Patent No.: US 10,010,190 B2
(45) **Date of Patent: *Jul. 3, 2018**

(54) POCKETED SPRING ASSEMBLY

(71) Applicant: L&P Property Management Company, South Gate, CA (US)

(72) Inventors: Guido Eigenmann, Carthage, MO (US); Darrell A. Richmond, Carthage, MO (US); Thomas W. Wells, Joplin, MO (US)

(73) Assignee: L&P Property Management Company, South Gate, CA (US)

( * ) Notice: Subject to any disclaimer, the term of this patent is extended or adjusted under 35 U.S.C. 154(b) by 316 days.

This patent is subject to a terminal disclaimer.

(21) Appl. No.: 15/150,731

(22) Filed: May 10, 2016

(65) Prior Publication Data

US 2016/0249744 A1 Sep. 1, 2016

Related U.S. Application Data

(63) Continuation-in-part of application No. 14/309,099, filed on Jun. 19, 2014, now Pat. No. 9,370,252.

(60) Provisional application No. 62/013,290, filed on Jun. 17, 2014.

(51) Int. Cl.

| | |
|---|---|
| ***A47C 27/06*** | (2006.01) |
| ***A47C 27/05*** | (2006.01) |
| ***A47C 21/04*** | (2006.01) |
| ***A47C 7/74*** | (2006.01) |

(52) U.S. Cl.

CPC ..... *A47C 27/064* (2013.01); *A47C 7/742* (2013.01); *A47C 21/042* (2013.01); *A47C 27/05* (2013.01)

(58) Field of Classification Search

CPC ..... A47C 23/00; A47C 23/043; A47C 23/002; A47C 23/04; A47C 23/0431; A47C 23/0438; A47C 27/04; A47C 27/064; A47C 27/06; A47C 27/063; A47C 27/065;

(Continued)

(56) References Cited

U.S. PATENT DOCUMENTS

| | | | |
|---|---|---|---|
| 5,868,383 | A | 2/1999 | Codos |
| 6,862,763 | B2 | 3/2005 | Mossbeck et al. |
| 7,908,693 | B2 | 3/2011 | DeMoss |

(Continued)

FOREIGN PATENT DOCUMENTS

| | | | | |
|---|---|---|---|---|
| DE | 4026502 C | * | 6/1991 | ..... A47C 23/0438 |
| KR | 20030061737 | | 7/2003 | |
| WO | WO-2013060983 A1 | * | 5/2013 | ..... A47C 27/064 |

*Primary Examiner* — Eric J Kurilla
*Assistant Examiner* — Amanda Lee Bailey
(74) *Attorney, Agent, or Firm* — Wood, Herron & Evans, LLP

(57) ABSTRACT

A pocketed spring assembly comprises a plurality of parallel strings of springs, each string joined to an adjacent string. Each string comprises a plurality of pockets formed along a length of the string by transverse seams joining first and second plies of fabric on opposed sides of springs. At least one spring is positioned in each pocket. Each spring has two end portions and a middle portion. The convolutions of the middle portion are greater in diameter and pitch than the convolutions of the end portions. Each interior transverse seam is cut or otherwise treated to create at least one divide enabling at least one end portion of the spring to compress without substantially compressing the middle portion of the spring.

17 Claims, 19 Drawing Sheets

(58) Field of Classification Search
CPC ..... A47C 27/07; A47C 7/742; A47C 21/042;
A47C 27/05; A47C 7/746
See application file for complete search history.

(56) References Cited

U.S. PATENT DOCUMENTS

| | | | |
|---|---|---|---|
| D681,980 | S | 5/2013 | DeFranks |
| 8,857,799 | B2 | 10/2014 | Tyree |
| 8,978,183 | B1 | 3/2015 | Richmond et al. |
| 9,370,252 | B2 | 6/2016 | Eigenmann et al. |
| 2007/0124865 | A1 | 6/2007 | Stjerna |
| 2007/0289068 | A1 | 12/2007 | Edling |
| 2010/0180385 | A1 | 7/2010 | Petrolati et al. |

* cited by examiner

POCKETED SPRING ASSEMBLY

CROSS-REFERENCE TO RELATED APPLICATIONS

This application is a continuation-in-part of U.S. patent application Ser. No. 14/309,099 filed Jun. 19, 2014 which claims the benefit of U.S. Provisional Patent Application Ser. No. 62/013,290 filed Jun. 17, 2014, each application being fully incorporated by reference herein.

FIELD OF THE INVENTION

This invention relates generally to bedding and seating products and, more particularly, to pocketed spring assemblies used in bedding and seating products.

BACKGROUND OF THE INVENTION

Mattress spring core construction over the years has been a continuously improving art with advancements in materials and machine technology. A well known form of spring core construction is known as a Marshall spring construction wherein metal coil springs are encapsulated in individual pockets of fabric and formed as elongate or continuous strings of pocketed coil springs. In an earlier form, these strings of coil springs were manufactured by folding an elongate piece of fabric in half lengthwise to form two plies of fabric and stitching transverse and longitudinal seams to join the plies of fabric to define pockets within which the springs were enveloped.

More recently, improvements in spring core constructions have involved the use of fabrics which are thermally or ultrasonically weldable to themselves. By using such welding techniques, these fabrics have been advantageously used to create strings of individually pocketed coil springs wherein transverse and longitudinal welds, instead of stitching, are used to form the pockets encapsulating the springs.

Once strings of pocketed springs are constructed, they may be assembled to form a spring core construction for a mattress, cushion or the like by a variety of methods. For example, multiple or continuous strings may be arranged in a row pattern corresponding to the desired size and shape of a mattress or the like, and adjacent rows of strings may be interconnected by a variety of methods. The result is a unitary assembly of pocketed coil springs serving as a complete spring core assembly.

Conventional pocketed spring cores incorporating pocketed strings of springs typically use springs of uniform diameter and pitch. U.S. Pat. No. 5,868,383 discloses a pocketed spring assembly incorporating springs which have different diameters and different pitches. An end portion of the pocketed spring may substantially compress before a middle portion compresses. The end portion may compress without the middle portion compressing when subject to lighter loads. However, due to the seams separating individual pockets extending the full height of the string of springs, the advantages of the coil springs may not be fully realized. The capability of the individually pocketed springs to act independently from the adjacent pocketed springs in the string of springs may be compromised.

Therefore, there remains a need to combine multiple technologies to improve the feel and motion transfer in a bedding or seating product having a pocketed spring core.

SUMMARY OF THE INVENTION

In one aspect, a bedding or seating product is provided. The product comprises a pocketed spring assembly comprising a plurality of parallel strings of springs, each string joined to an adjacent string, each string comprising first and second opposed plies of fabric and a plurality of pockets formed along the length of the string by transverse or separating seams joining the first and second plies, and at least one spring positioned in each pocket. Each of the springs has upper and lower end turns and a plurality of central convolutions between the end turns, the convolutions decreasing in diameter and pitch from a middle portion of the spring towards the end turns. Each of the springs is preferably made of one piece of wire of a uniform diameter. Each transverse seam forming adjacent pockets of the string is cut or otherwise treated to create at least one divide so as to enable at least one end portion of the spring to compress without substantially compressing the middle portion of the spring. Cushioning materials may be placed on the pocketed spring assembly, and an upholstered covering may encase the pocketed spring assembly and cushioning materials.

The strings of springs can extend longitudinally or transversely. A bedding or seating product may be posturized into regions or zones of different firmness by incorporating different strings of springs into the product.

If the strings of springs extend transversely, the product can include a plurality of the strings having a "split top" feature in the seams between adjacent pockets and a plurality of the strings lacking the "split top" feature, the plurality of strings arranged in a plurality of zones longitudinally spaced apart. For example, the product can include three such zones. The three zones can comprise a central zone, a head end zone and a foot end zone. The end zones can have strings of springs having the "split top" feature, and the strings of springs comprising central zone can have strings of springs lacking the "split top" feature. Alternatively, the end zones can have strings of springs lacking the "split top" feature, and the strings of springs comprising central zone can have strings of springs with the "split top" feature.

If the strings of springs extend longitudinally, the product can include a plurality of the strings having the "split top" feature in the seams between adjacent pockets and a plurality of the strings lacking the "split top" feature, the plurality of strings arranged in a plurality of zones transversely spaced apart. For example, the product can include two such zones, a "his" side and a "hers" side. The "hers" side or zone can have strings of springs having the "split top" feature, and the "his" side or zone can comprise strings of springs lacking the "split top" feature.

In another aspect, a pocketed spring assembly for a bedding or seating product is provided. The pocketed spring assembly comprises a plurality of parallel strings of springs. Each string is joined to an adjacent string of springs. Each of the strings comprises a plurality of interconnected pockets. Each of the pockets contains at least one spring encased in fabric. The fabric is joined to itself along a longitudinal seam and has first and second opposed plies of fabric on opposite sides of the springs. The fabric of the first and second plies is joined by transverse seams. Each of the springs has upper and lower end turns and a plurality of central convolutions between the end turns. The spring has two end portions and a middle portion between the end portions, the convolutions of the middle portion being greater in diameter and pitch than the convolutions of the end portions of the spring. Each of the springs is preferably made of one piece of wire of a uniform diameter. Each of the transverse seams forming the adjacent pockets of the string has at least one divide, each upper divide having an end located below an upper surface of the string of springs and each lower divide having an end located above a lower surface of the string of springs so as to partially separate the adjacent pockets. An upper divide extending downwardly from an upper end of the transverse seam has a lower end located below an upper surface of the string to allow at least one end portion of the spring to compress upon being subjected to a load in a one-sided product. In a two-sided product, each interior transverse seam has an upper and lower divide, the lower divide extending upwardly from a lower surface of the string and having an upper end located above the lower surface of the string.

In another aspect, a string of springs for a pocketed spring assembly for a bedding or seating product is provided. The pocketed spring assembly comprises a plurality of parallel strings of springs. Each string is joined to an adjacent string of springs. Each of the strings comprises a plurality of interconnected pockets. Each of the pockets contains at least one spring encased in fabric. The fabric is joined to itself along a longitudinal seam and has first and second opposed plies of fabric on opposite sides of the springs. The fabric of the first and second plies is joined by transverse seams. Each of the springs has two end portions and a middle portion between the end portions, the convolutions of the middle portion being greater in diameter and pitch than the convolutions of the end portions of the spring. Each of the springs is preferably made of one piece of wire of a uniform diameter. Each of the transverse seams forming the adjacent pockets of the string has an upper end located below an upper surface of the string of springs so as to partially separate the adjacent pockets and enable an upper end portion of the spring to compress without substantially compressing the middle portion of the spring.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE INVENTION

Figure 1:
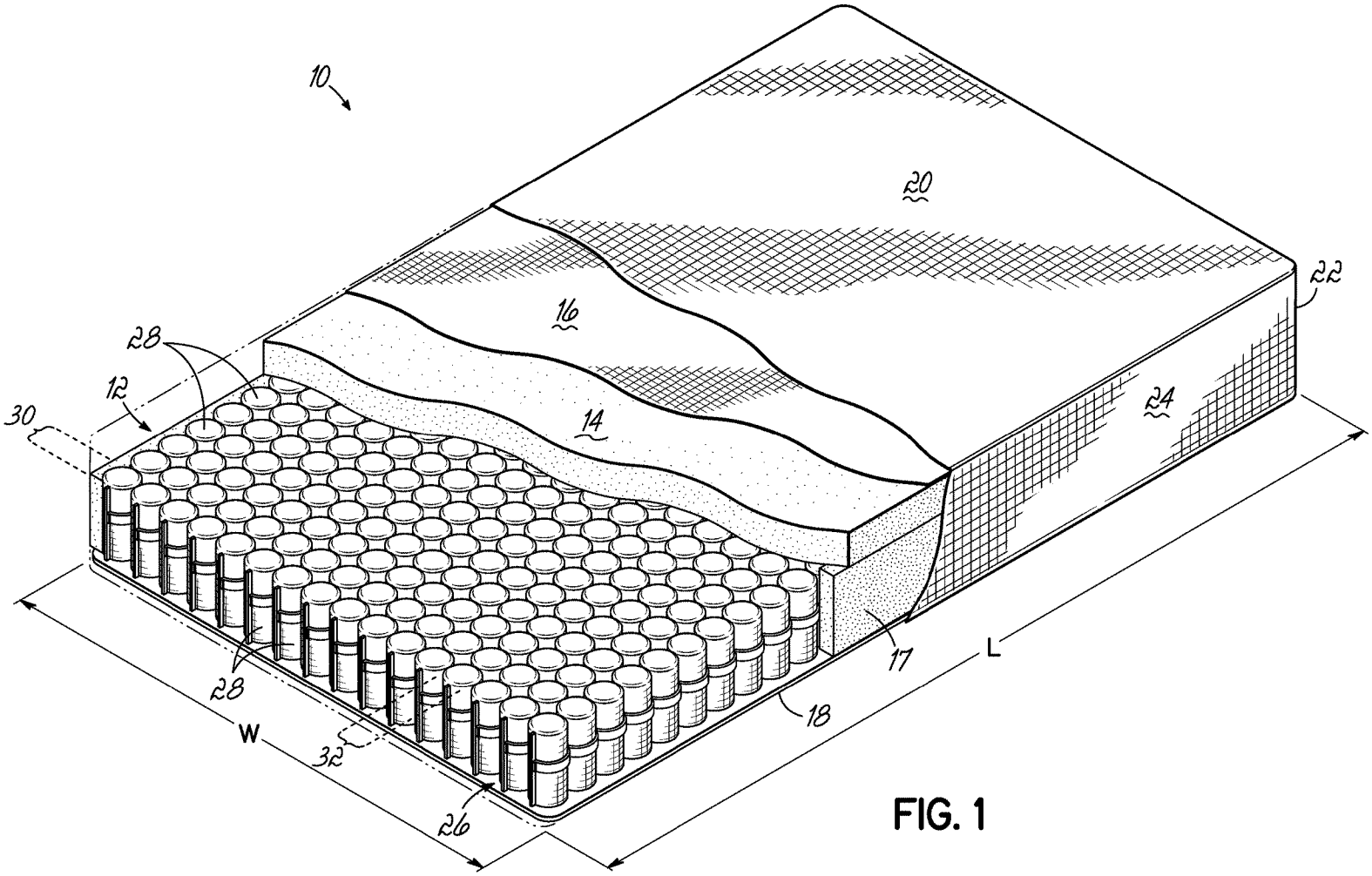
FIG. 1 is a perspective view, partially broken away, of a bedding or seating product incorporating a pocketed spring assembly according to the principles of the present invention.

Referring first to FIG. 1, there is illustrated a bedding product in the form of a single-sided mattress 10 incorporating the principles of the present invention. This product or mattress 10 comprises a pocketed spring assembly 12 over the top of which there lay conventional padding or cushioning layers 14, 16 which may be foam, fiber, gel, a pocketed spring blanket or any other suitable materials or any combination thereof. The pocketed spring assembly 12 is surrounded with a border 17 made of foam or any other suitable material (only a portion being shown in FIG. 1). Although one type of border 17 is illustrated, the border may assume other forms or shapes of any desired size, such as pocketed coil springs. Alternatively, the border 17 may be omitted in this embodiment or any embodiment described or shown herein. This complete assembly is mounted upon a base 18 and is completely enclosed within an upholstered covering material 20. The base 18 and border 17 are known in the industry as a "bucket" into which a pocketed spring assembly 12 may be inserted before the "bucket" is covered with one or more padding or cushioning layers.

As shown in FIG. 1, fully assembled, the product 10 has a length "L" defined as the linear distance between opposed end surfaces 22 (only one being shown in FIG. 1). Similarly, the assembled product 10 has a width "W" defined as the linear distance between opposed side surfaces 24 (only one being shown in FIG. 1). In the product shown in FIG. 1, the length is illustrated as being greater than the width. However, it is within the scope of the present invention that the length and width may be identical, as in a square product.

As shown in FIG. 1, pocketed spring assembly 12 is manufactured from multiple strings 26 of pocketed springs 28 joined together. Each string of pocketed springs 26 extends longitudinally or from head-to-foot along the full length of the product 10.

Figure 1A:
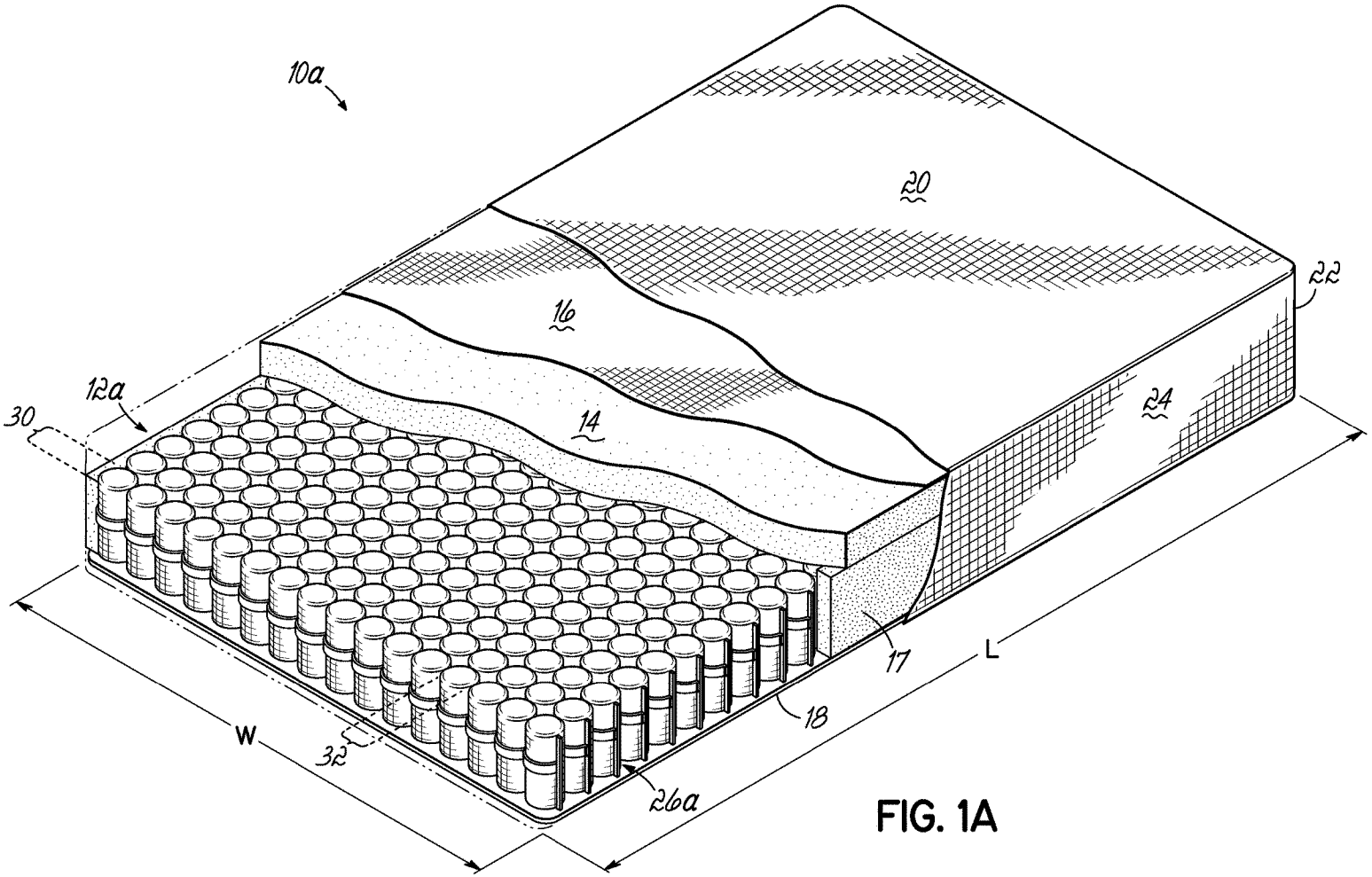
FIG. 1A is a perspective view, partially broken away, of a bedding or seating product incorporating another pocketed spring assembly.

Although the strings of pocketed springs 26 are illustrated as extending longitudinally or from head-to-foot in the pocketed spring assembly 12 of FIG. 1, they may extend transversely or from side-to-side as shown in the pocketed spring assembly 12*a* shown in the product 10*a* shown in FIG. 1A. The pocketed spring assembly 12*a* comprises multiple strings 26*a* of pocketed springs, identical to the strings of springs 26, but shorter in length.

Figure 1B:
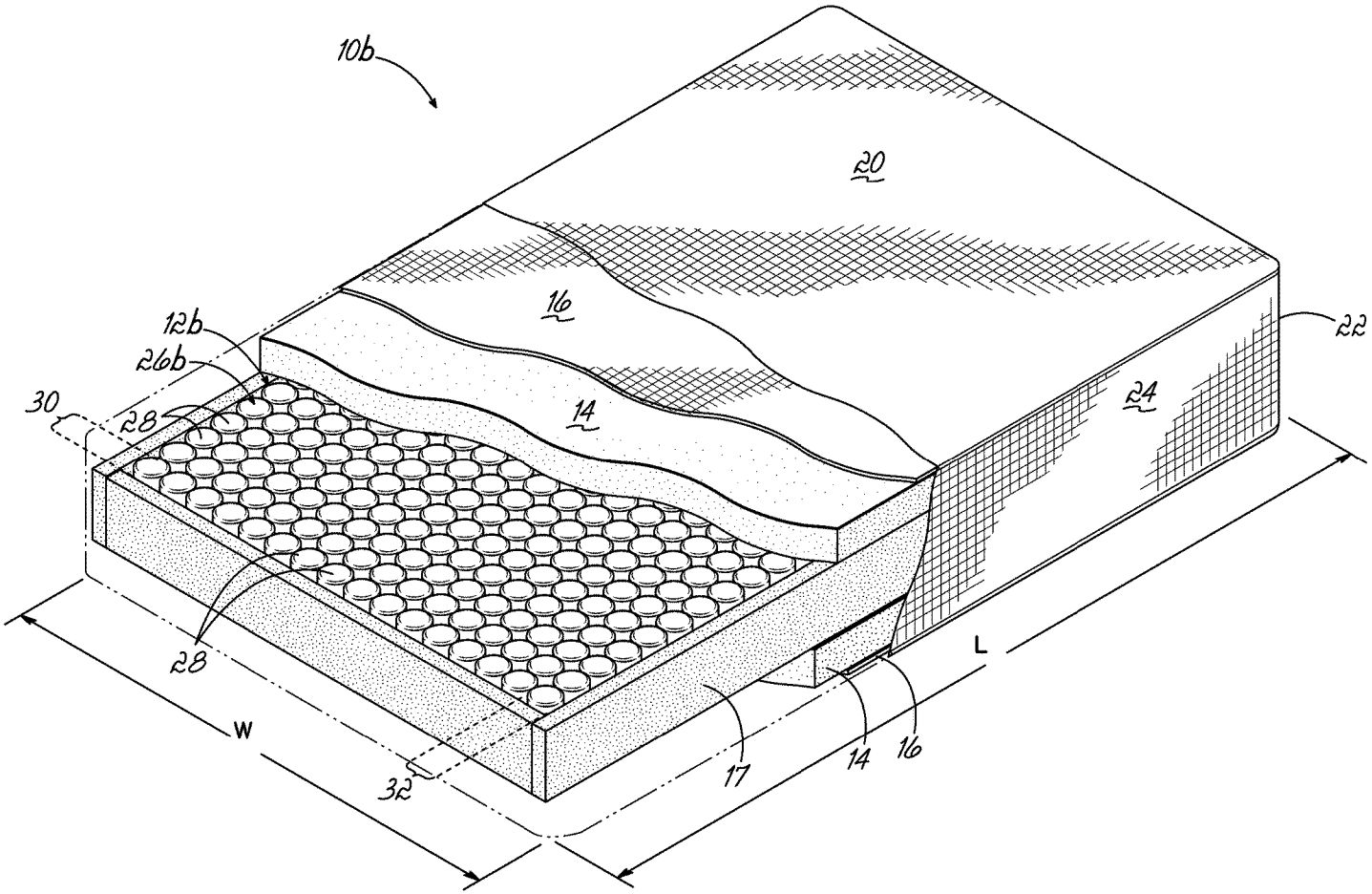
FIG. 1B is a perspective view, partially broken away, of a double-sided bedding product incorporating another pocketed spring assembly.

FIG. 1B illustrates a double-sided mattress 10*b* comprising a pocketed spring assembly 12 and border 17 identical to those shown in the mattress 10 of FIG. 1. However, the mattress 10*b* of FIG. 1B has conventional padding layers 14, 16 above and below a double-sided pocketed spring assembly 12*b*. The double-sided pocketed spring assembly 12*b* comprises a plurality of strings 26*b* of pocketed springs, one being partially shown in cross-section in FIG. 6.

Figure 1C:
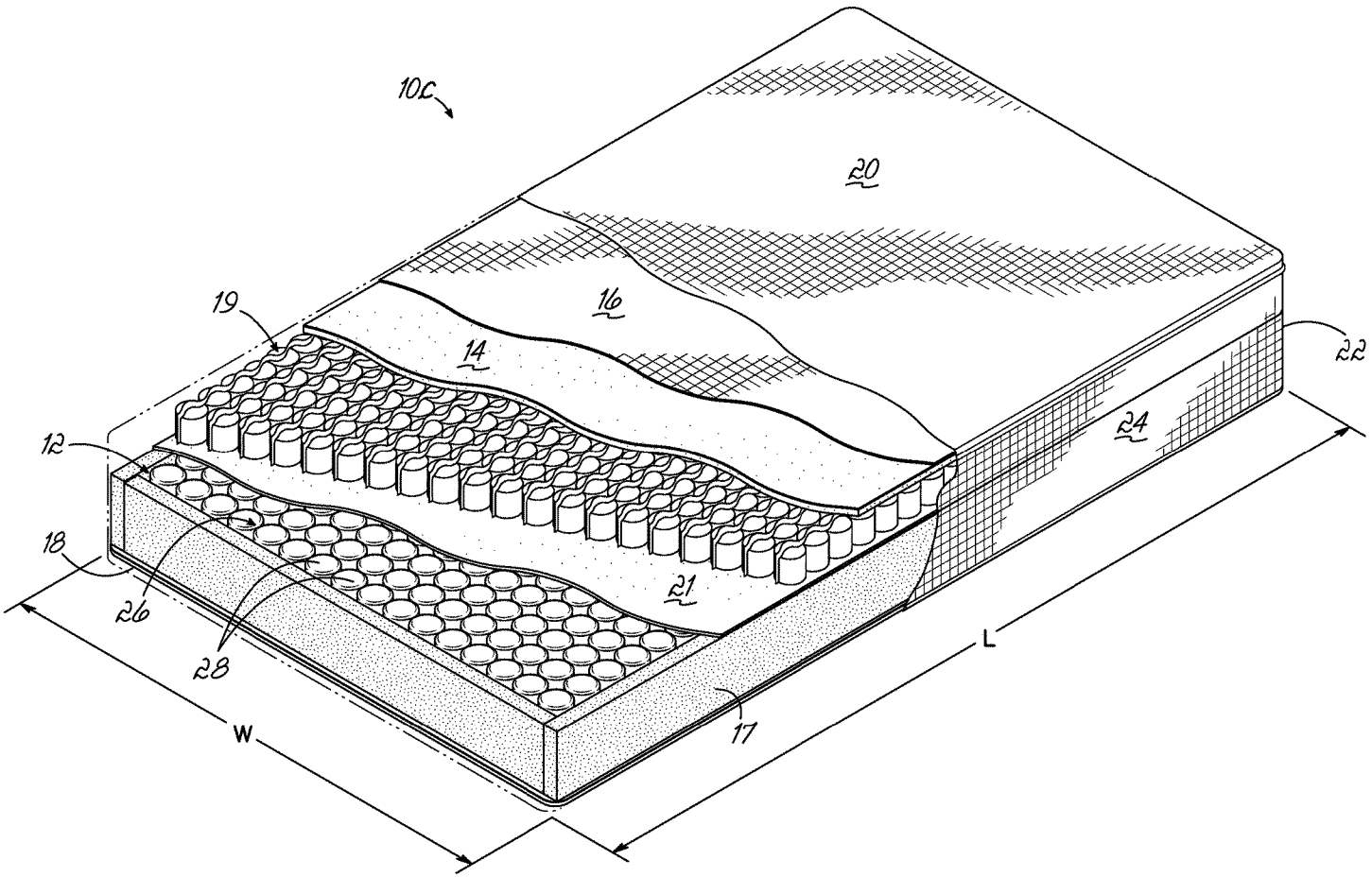
FIG. 1C is a perspective view, partially broken away, of another bedding product incorporating the pocketed spring assembly of FIG. 1.

FIG. 1C illustrates a single-sided mattress 10*c* comprising a pocketed spring assembly 12 and border 17 identical to those shown in the mattress 10 of FIG. 1. However, the mattress 10*c* of FIG. 1C has a pocketed topper 19 employing miniature or small strings of pocketed coil springs in addition to padding layers 14, 16 above the pocketed topper 19. A scrim layer 21 separates the pocketed topper 19 from the pocketed spring assembly 12. Although one configuration of pocketed topper 19 is illustrated, any pocketed topper known in the art may be used.

According to the practice of this invention, any of the padding or cushioning layers, including the pocketed topper 19, may be omitted in any of the embodiments shown or described herein. The novel features reside in the pocketed spring assembly.

These strings of pocketed springs 26, 26*a* and 26*b*, and any other strings of springs described or shown herein, may be connected in side-by-side relationship as, for example, by gluing the sides of the strings together in an assembly machine, so as to create an assembly or matrix of springs having multiple rows and columns of pocketed springs bound together as by gluing, welding or any other conventional assembly process commonly used to create pocketed spring cores or assemblies.

Figure 4:
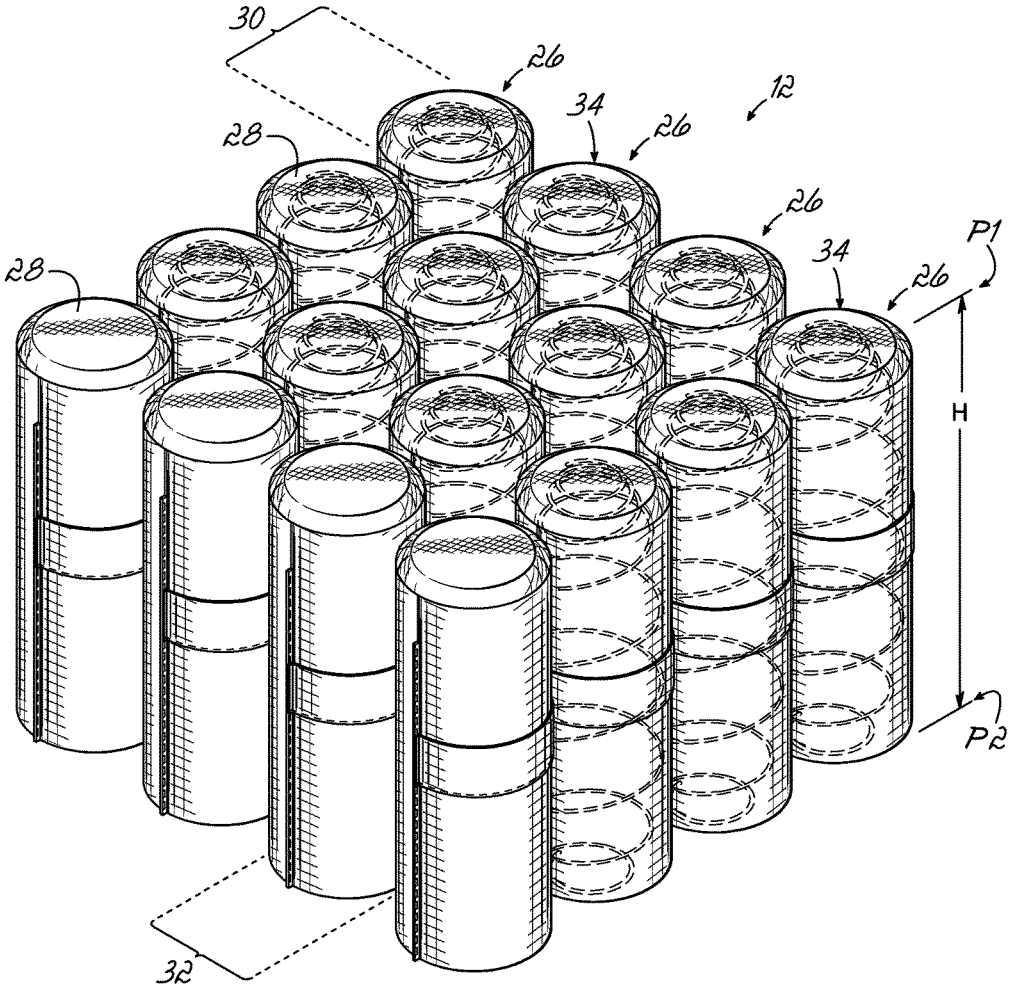
FIG. 4 is a perspective view of a portion of the pocketed spring assembly of FIG. 1 in a relaxed condition.
Figure 5:
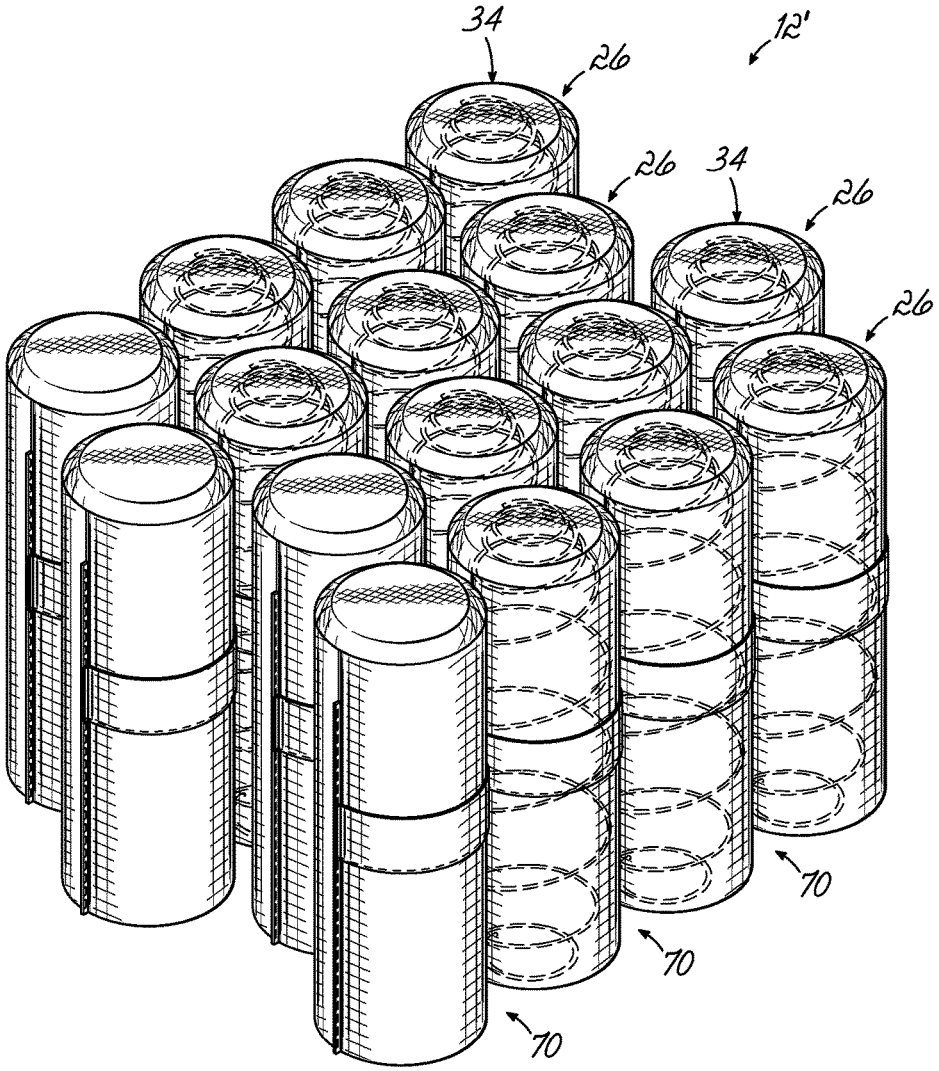
FIG. 5 is a perspective view of a portion of another pocketed spring assembly in a relaxed condition, the strings of springs being offset from one another.

Referring to FIGS. 4 and 5, the strings 26, 26*a* and 26*b* of pocketed springs may be joined so that the individually pocketed springs 28 are aligned in transversely extending rows 30 and longitudinally extending columns 32. Alternatively, the strings 26, 26*a* and 26*b* of pocketed springs may be offset from one another in a pocketed spring assembly. In such an arrangement, shown in FIG. 5, the individually pocketed springs are not aligned in rows and columns; instead the individually pocketed springs fill gaps or voids 70 of the adjacent strings of pocketed springs. FIG. 5 shows a portion of a pocketed spring assembly 12' with multiple strings of springs 26 arranged in this manner. This alignment of strings of springs may be incorporated into any of the pocketed spring assemblies or cores illustrated or described herein.

Figure 2:
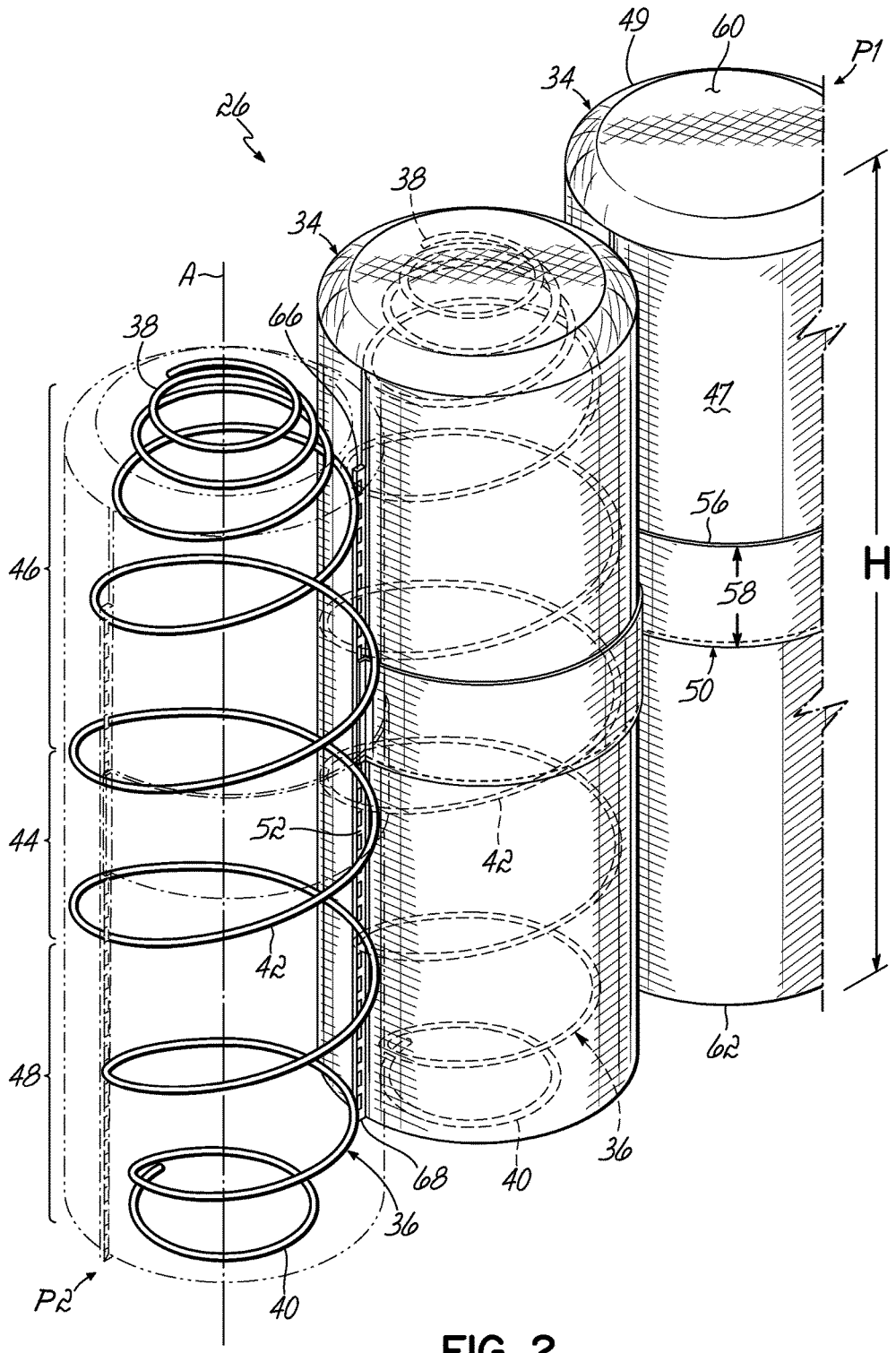
FIG. 2 is a perspective view, partially broken away, of a portion of a string of springs of FIG. 1 in an unloaded condition.
Figure 3A:
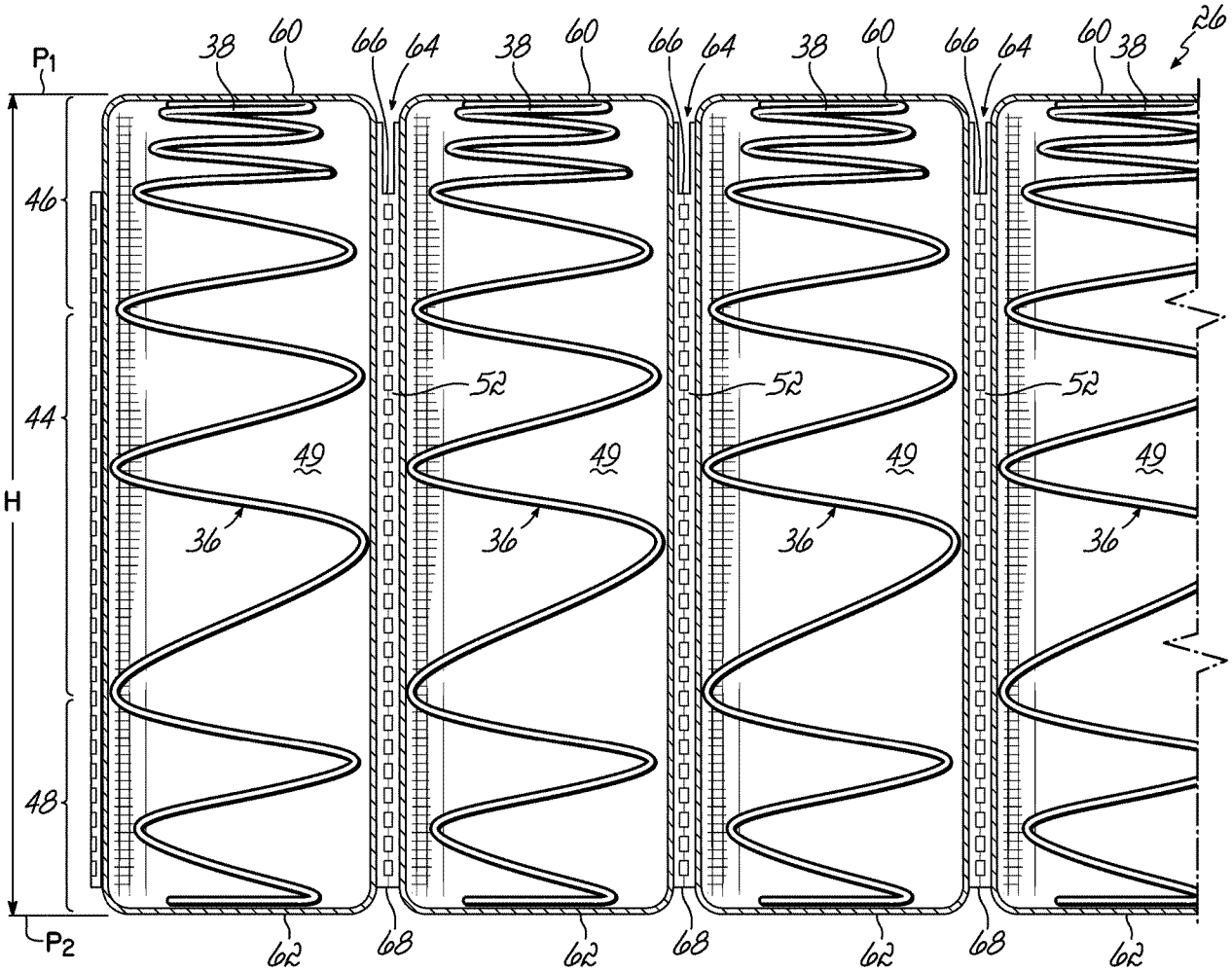
FIG. 3A is a cross-sectional view, partially broken away, of the string of springs of FIG. 2 in an unloaded condition.
Figure 3B:
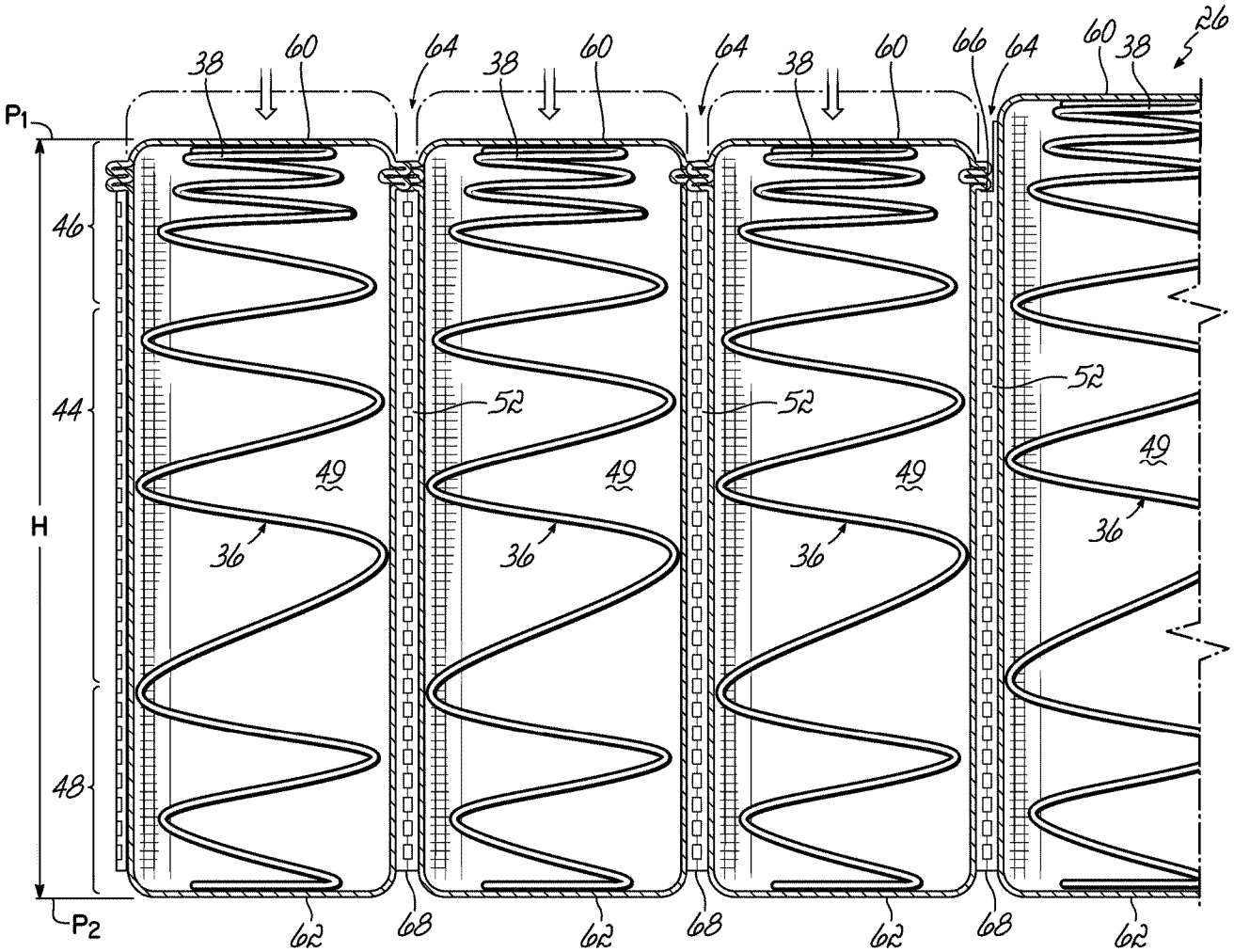
FIG. 3B is a view similar to FIG. 3A, a portion of the string of springs of FIG. 3A being in a loaded condition.

As best illustrated in FIGS. 2, 3A and 3B, each string 26 of pocketed springs 28 comprises a row of interconnected fabric pockets 34. Each of the fabric pockets 34 contains at least one coil spring 36. The coil spring 36 is preferably made of one piece of wire of a uniform diameter, but may be made of other materials, multiple strands of twisted wire and/or may be a non-uniform diameter. As best shown in FIG. 2, each coil spring 36 has a central or longitudinal axis A, an upper end turn 38, a lower end turn 40 and a plurality of central convolutions 42 between the end turns. FIGS. 2 and 3A illustrate a barrel-shaped coil spring 36 in which the diameter of the end turns 38, 40 is less than the diameter of the central convolutions 42, the central convolutions 42 tapering or decreasing in diameter and pitch as one moves from a center or middle portion 44 of the coil spring towards the end turns. As best shown in FIG. 2, each barrel-shaped coil spring 36 has two end portions which are not identical, an upper end portion 46 and a lower end portion 48. The upper end portion 46 has more convolutions than the lower end portion 48, as best shown in FIGS. 3A and 3B.

Preferably, one piece of fabric is used to create the string of pocketed springs 26, the piece of fabric being folded over onto itself around the coil springs 36. As best shown in FIG. 2, opposite sides or plies 47, 49 of the fabric are sewn, welded or otherwise secured together in order to create a longitudinal seam 50 and a plurality of separating or transverse seams 52. FIG. 2 illustrates ply 47 being closest to the reader and ply 49 being behind the springs 36.

Although the seams or welds in all of the embodiments shown herein are shown as being heat welded spaced rectangles, any of the seams may be spaced dots, triangles or solid line segments without spaces.

As best shown in FIG. 2, opposed edges 56 of the piece of fabric used to create the string of pocketed springs 26 are aligned and spaced from the longitudinal seam 50 a distance indicated by numeral 58. Although the drawings indicated the longitudinal seam 50 being below the free edges 56 of the piece of fabric, the longitudinal seam 50 may be above the free edges 56 of the piece of fabric.

As shown in FIGS. 2 and 3A, the string of pocketed springs 26 has a generally planar top surface 60 in a top plane P1 and a parallel generally planar bottom surface 62 in a bottom plane P2. The linear distance between the top and bottom surfaces of the string of pocketed springs 26 defines a height H of the string of pocketed springs 26. This linear distance further defines the height H of the pocketed spring assembly 12 because each of the strings of springs 26 has the same height. However, it is within the scope of the present invention that different strings of springs of a pocketed spring assembly have different heights.

In accordance with an embodiment of the present invention, in strings 26 of pocketed springs 28, the transverse seams 52 forming the adjacent pockets 34 are divided as at 64 to thereby form a cut, slit, or notch by, for example, cutting, slitting, severing, melting, or the like, from the upper surface 60 of the string of pocketed springs 26 inwardly (downwardly as illustrated), so as to partially separate the adjacent pockets 34. Preferably, the divide 64 extends to beyond or below the upper end turn 38 of the spring 36. As best shown in FIGS. 2 and 3A, the transverse seams 52 of the strings of springs 26 each have an upper end 66 located at the bottom of each divide 64 and a lower end 68. As shown in FIG. 3A, the upper end 66 of each transverse seam 52 is located below the upper end turn 38 and multiple convolutions of the adjacent coil springs 36 when the coil springs 36 are in a relaxed condition.

The significance of divide 64 may be appreciated with reference to FIG. 3B. Divide 64 essentially decouples each coil spring 36 from its adjacent coil spring 36 during initial deflection of coil spring 36. This creates more of an individual coil performance and allows the coil spring 36 to engage a person sleeping on the mattress 10 sooner while giving the person a softer feel at the beginning of the coil deflections. It is believed that this arrangement provides a more comfortable product 10.

Figure 6:
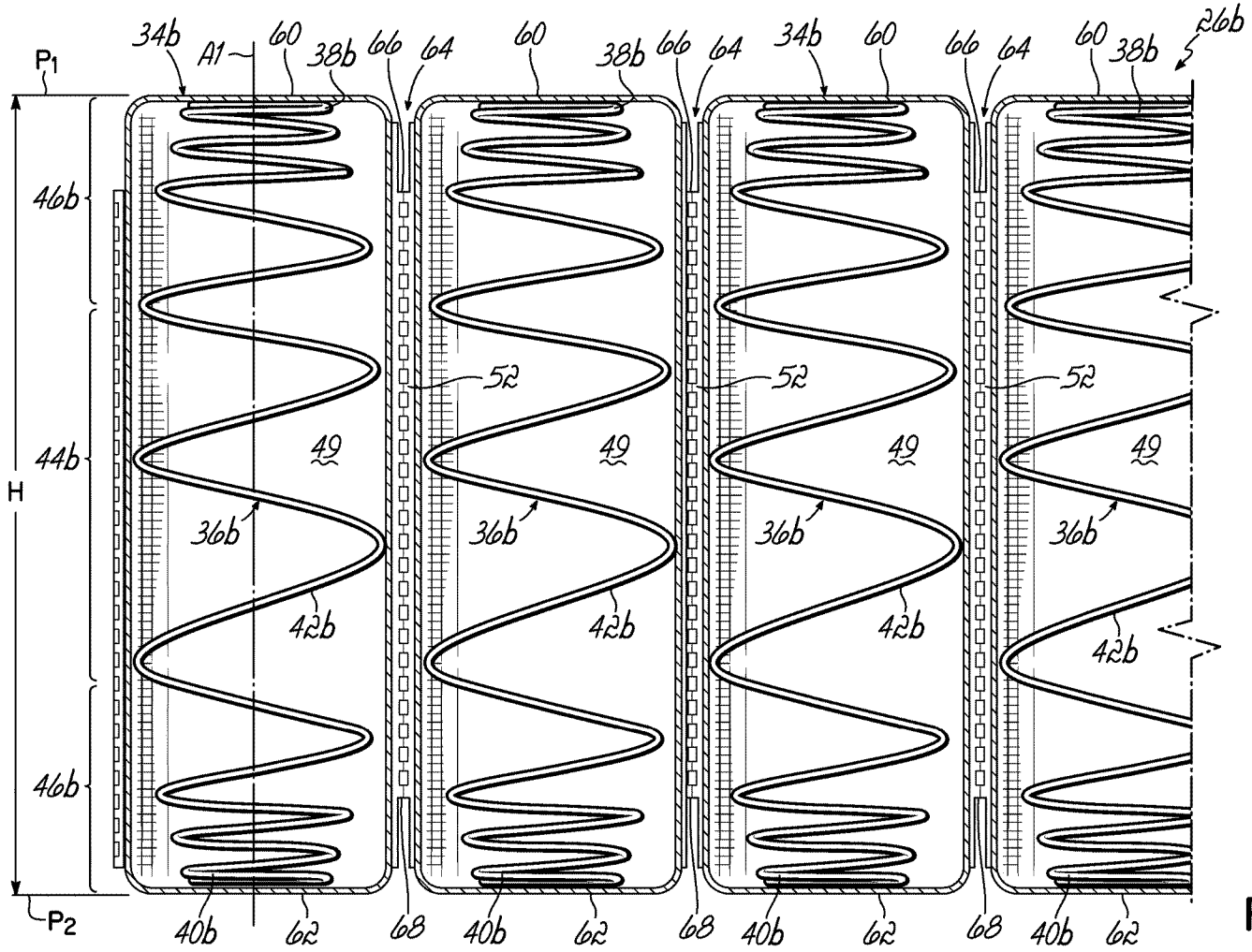
FIG. 6 is a cross-sectional view, partially broken away, of another string of springs in an unloaded condition.

Referring now to FIGS. 1B and 6, while the mattresses 10 illustrated in FIGS. 1 and 1A are single-sided mattresses, any other pocketed spring assembly shown or described herein, may be incorporated into any bedding or seating product, including a double-sided mattress or seating cushion.

FIG. 6 illustrates a portion of a string of springs 26*b* used in a double-sided mattress, like mattress 12*b* shown in FIG. 1B. The fabric pockets 34*b* of such strings of springs 26*b* are slightly different than the fabric pockets 34 of string of springs 26. There are divides 64 along the tops and bottoms of the string of springs 26*b*. Additionally, the coil springs 36*b* are different than the coil springs 36. Each coil spring 36*b* comprises a central or longitudinal axis A1, an upper end turn 38*b*, a lower end turn 40*b* and a plurality of central convolutions 42*b* between the end turns. FIGS. 1B and 6 illustrate a barrel-shaped coil spring 36*b* in which the diameter of the end turns 38*b*, 40*b* is less than the diameter of the central convolutions 42*b*, the central convolutions 42*b* tapering or decreasing in diameter and pitch as one moves from a center or middle portion 44*b* of the coil spring towards the end turns. As best shown in FIG. 6, each barrel-shaped coil spring 36*b* has two identical end portions 46*b*.

Figure 7A:
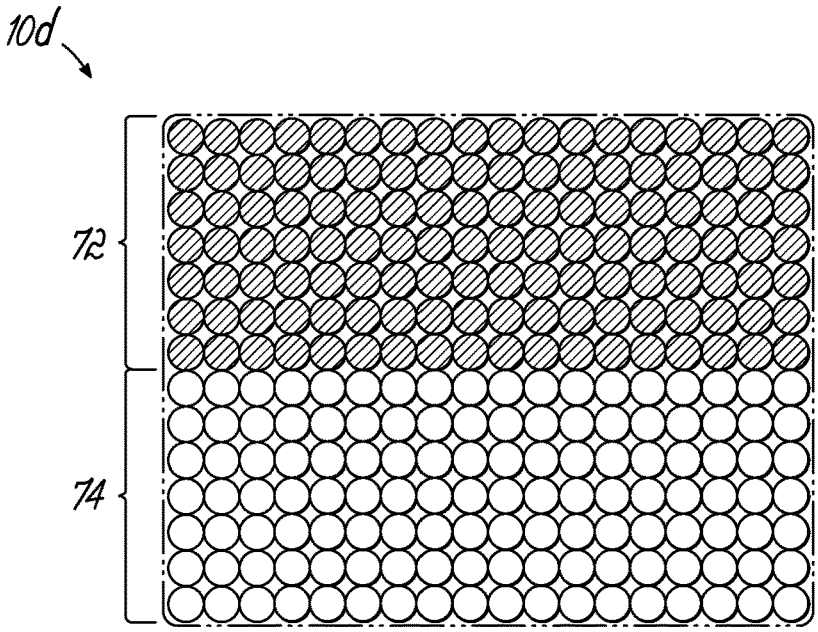
FIG. 7A is a top view of a posturized pocketed spring assembly.

Referring now to FIG. 7A, longitudinally extending strings of springs are shown in one preferable arrangement for a spring core for a bedding or seating product, such as a mattress. As can be seen, the longitudinally extending strings of springs are arranged in a plurality of zones on the mattress 10*d*. By way of example, two zones 72, 74 are illustrated, with the zones corresponding roughly to a "firm" side and a "soft" side. By way of further example, the longitudinally extending strings of springs of the "soft" zone 72 are each strings of springs 26 or 26*b* having the split top feature shown and described herein. The longitudinally extending strings of springs of the "firm" zone 74 are each strings of springs lacking any split top feature. Of course, other arrangements are within the scope of the invention. For example, the mattress shown in FIG. 7A may comprise transversely extending strings of springs rather than longitudinally extending strings of springs. In such an arrangement, each transversely extending string of springs would have to be half firm and half soft. Therefore, each string of springs would have only half the string having the split top feature, the other half lacking such feature.

Figure 7B:
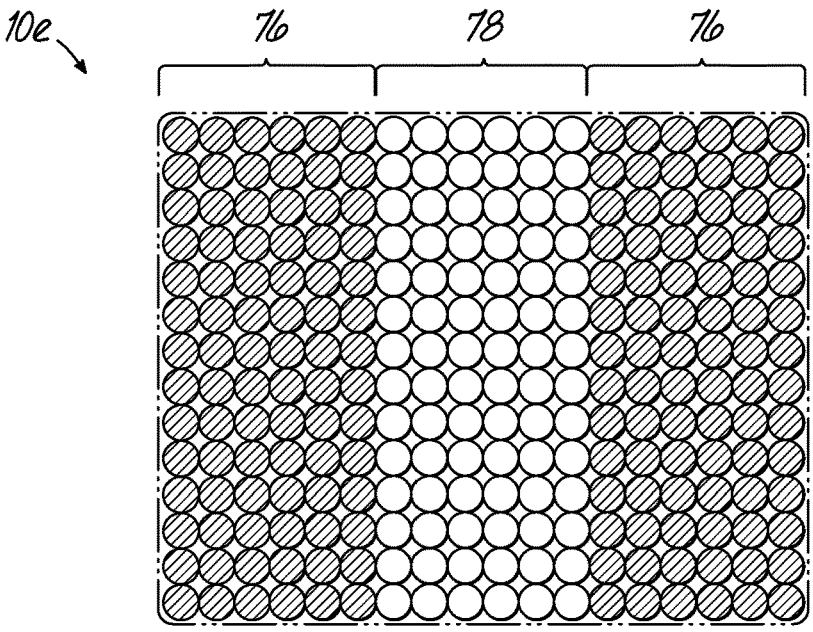
FIG. 7B is a top view of another posturized pocketed spring assembly.

Referring now to FIG. 7B, the transversely extending strings of springs are shown in one preferable arrangement for a spring core for a bedding or seating product, such as a mattress 10*e*. As can be seen, the transversely extending strings of springs are arranged in a plurality of zones on the mattress 10*e*. By way of example, three zones are illustrated, with the zones corresponding roughly to the location of a sleeper's head and shoulders, mid-section, knees and feet. By way of further example, the two end "soft" zones 76 each comprise strings of springs 26, 26*a* or 26*b* having the split top feature shown and described herein. The transversely extending strings of springs of the middle or "firm" zone 78 are each strings of springs lacking any split top feature. Of course, other arrangements are within the scope of the invention. For example, the mattress shown in FIG. 7B may comprise longitudinally extending strings of springs rather than transversely extending strings of springs. In such an arrangement, each longitudinally extending string of springs would have to be divided into three sections; a middle "firm" section and two end or "soft" sections. Therefore, each string of springs would have only the end thirds of the string having the split top feature, the middle third lacking such feature.

Figure 8:
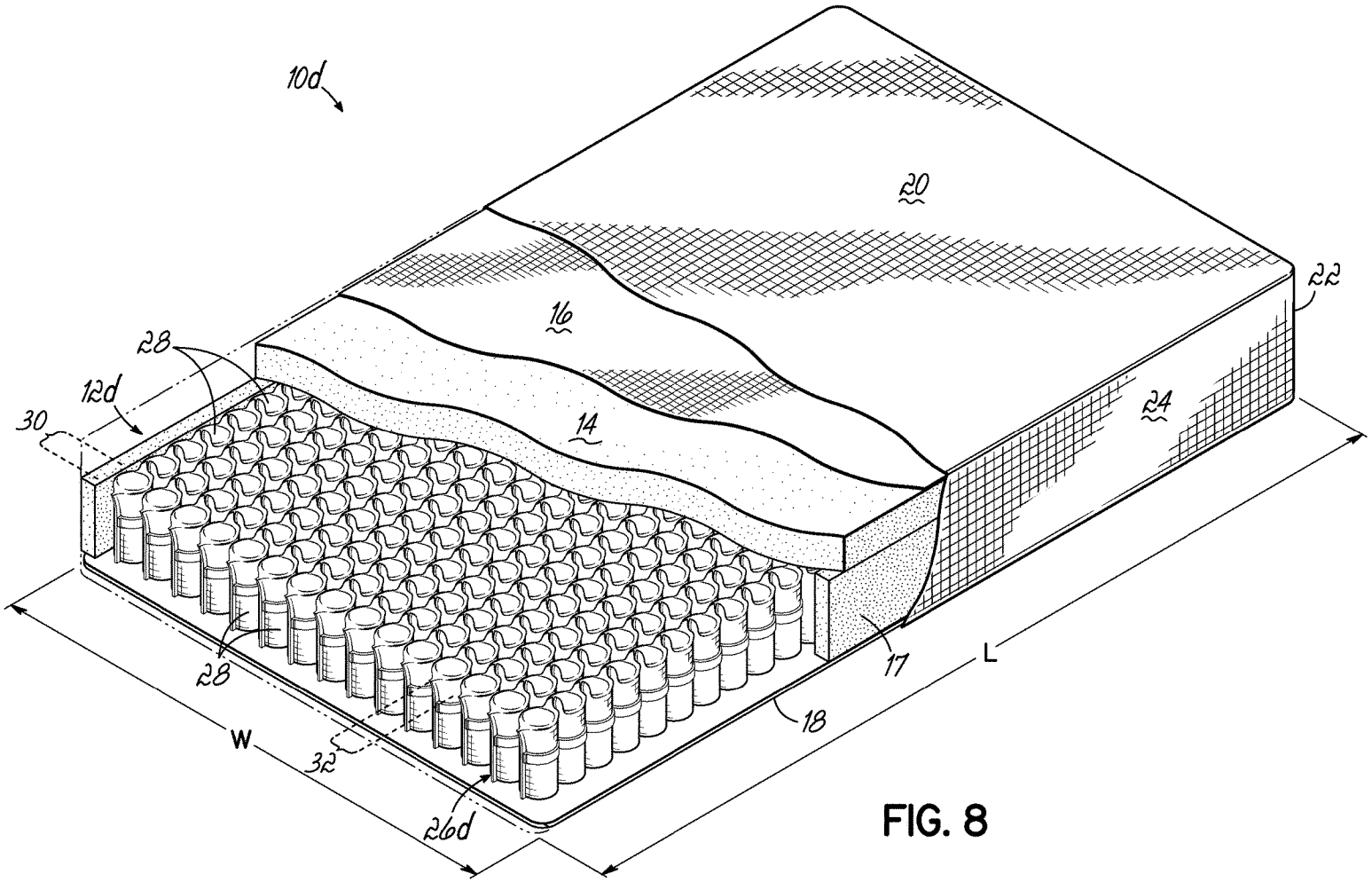
FIG. 8 is a perspective view, partially broken away, of a bedding or seating product incorporating a pocketed spring assembly according to the principles of the present invention.

FIG. 8 illustrates another embodiment of a bedding product in the form of a single-sided mattress 10*d*. This product or mattress 10*d* comprises a pocketed spring assembly 12*d* over the top of which there lay conventional padding or cushioning layers 14, 16 which may be foam, fiber, gel, a pocketed spring blanket or any other suitable materials or any combination thereof. The pocketed spring assembly 12*d* may be surrounded with a border 17 made of foam or any other suitable material (only a portion being shown in FIG. 8). Although one type of border 17 is illustrated, the border may assume other forms or shapes of any desired size, such as pocketed coil springs. Alternatively, the border 17 may be omitted in this embodiment or any embodiment described or shown herein. This complete assembly is mounted upon a base 18 and is completely enclosed within an upholstered covering material 20. The base 18 and border 17 are known in the industry as a "bucket" into which a pocketed spring assembly 12*d* may be inserted before the "bucket" is covered with one or more padding or cushioning layers. The bucket or any portion thereof may be omitted in any embodiment described or shown herein.

As shown in FIG. 8, fully assembled, the product 10*d* has a length "L" defined as the linear distance between opposed end surfaces 22 (only one being shown in FIG. 1). Similarly, the assembled product 10*d* has a width "W" defined as the linear distance between opposed side surfaces 24 (only one being shown in FIG. 1). In the product shown in FIG. 1, the length is illustrated as being greater than the width. However, it is within the scope of the present invention that the length and width may be identical, as in a square product.

As shown in FIG. 8, pocketed spring assembly 12*d* is manufactured from multiple strings 26*d* of pocketed springs 28 joined together. Each string of pocketed springs 26*d* extends longitudinally or from head-to-foot along the full length of the product 10*d*.

Figure 8A:
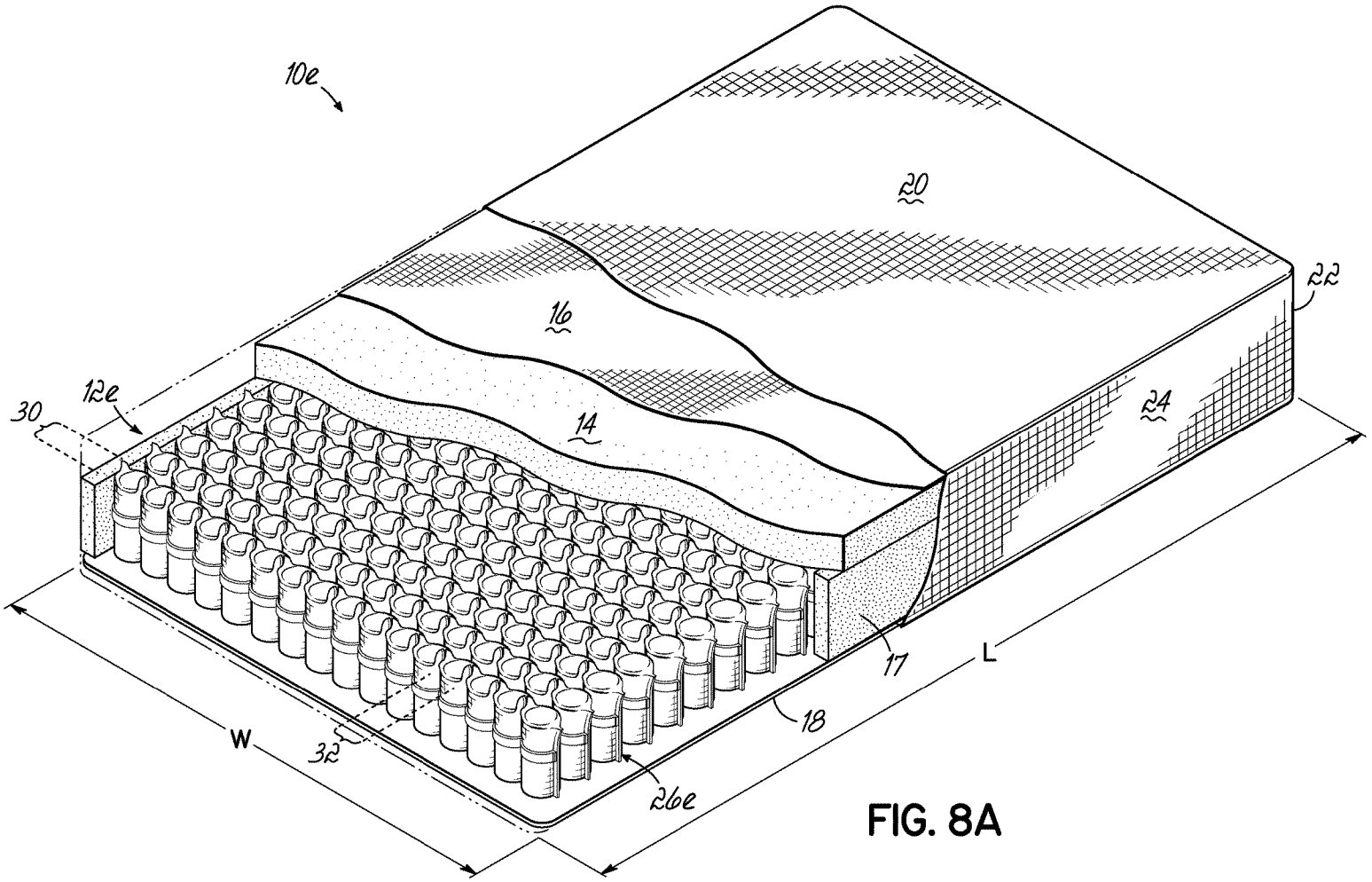
FIG. 8A is a perspective view, partially broken away, of a bedding or seating product incorporating another pocketed spring assembly.

Although the strings of pocketed springs 26*d* are illustrated as extending longitudinally or from head-to-foot in the pocketed spring assembly 12*d* of FIG. 8, they may extend transversely or from side-to-side as shown in the pocketed spring assembly 12*e* shown in the product 10*e* shown in FIG. 8A. The pocketed spring assembly 12*e* comprises multiple strings 26*e*, identical to the strings 26*d*, but shorter in length.

Figure 8B:
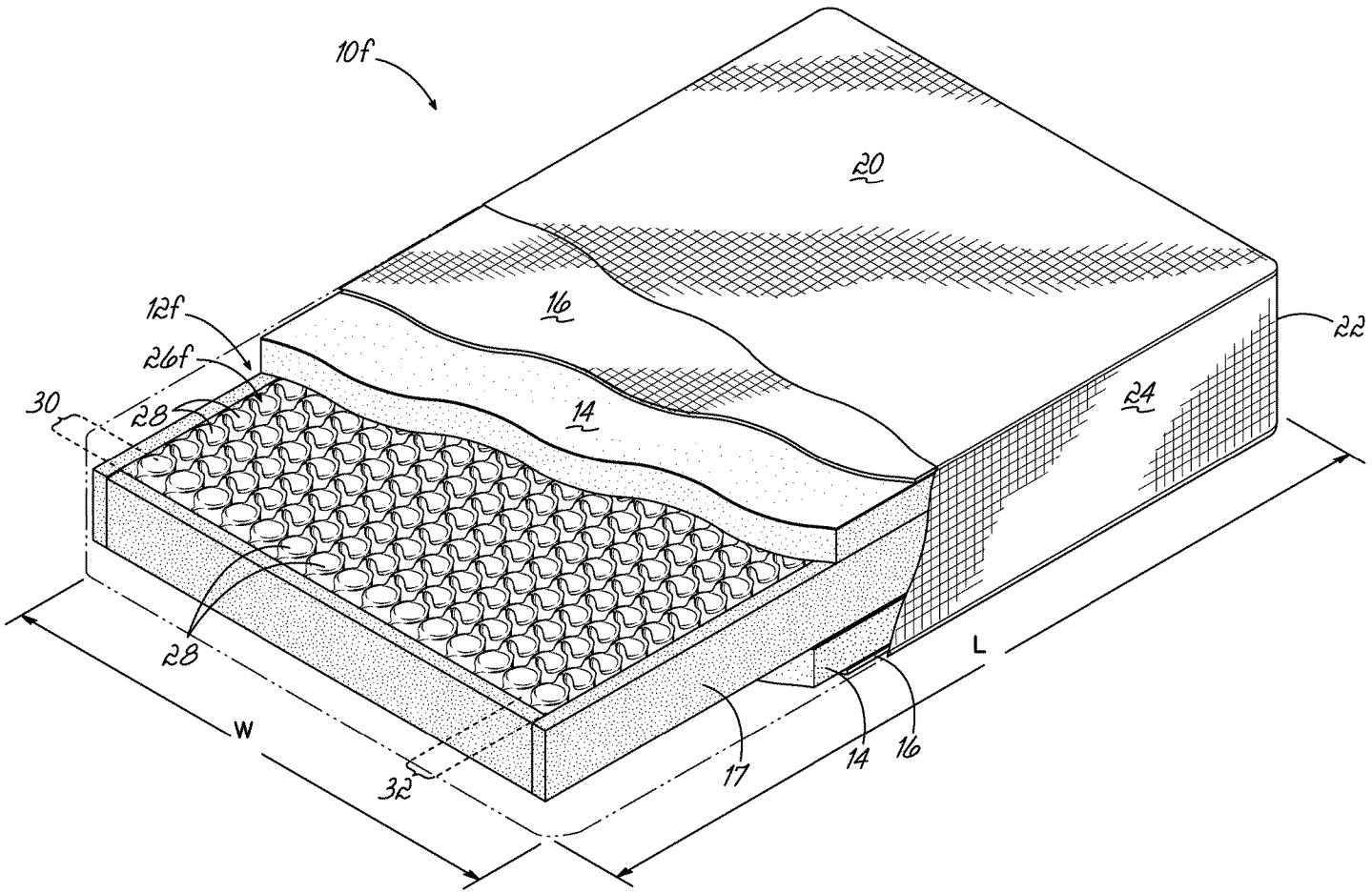
FIG. 8B is a perspective view, partially broken away, of a double-sided bedding product incorporating another pocketed spring assembly.

FIG. 8B illustrates a double-sided mattress 10*f* comprising a pocketed spring assembly 12*f* and border 17. However, the mattress 10*f* of FIG. 8B has conventional padding layers 14, 16 above and below a double-sided pocketed spring assembly 12*f*. The double-sided pocketed spring assembly 12*f* comprises a plurality of strings 26*f* of pocketed springs, one being partially shown in cross-section in FIGS. 11A and 11B.

Figure 9:
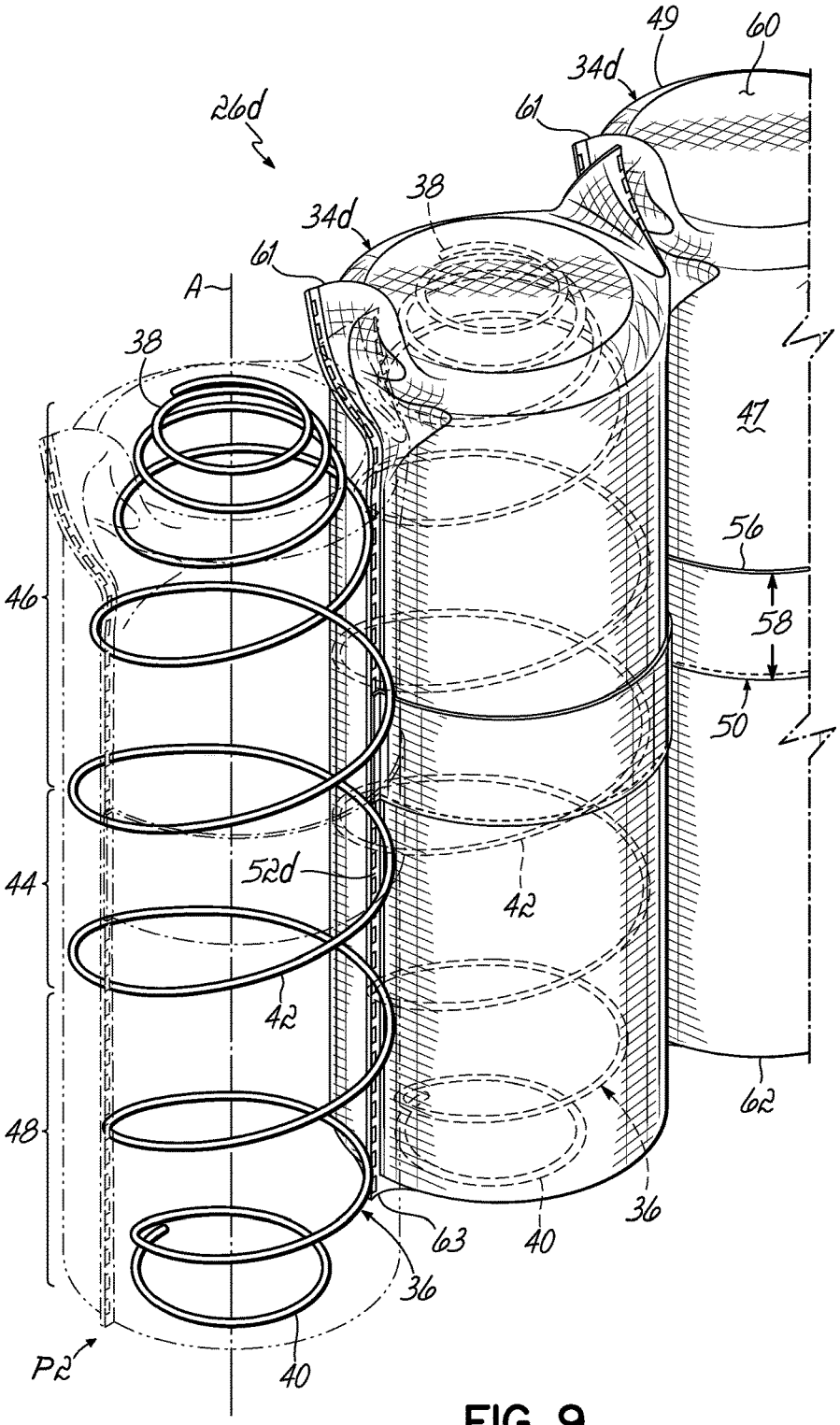
FIG. 9 is a perspective view, partially broken away, of a portion of a string of springs of FIG. 8 in an unloaded condition.
Figure 10A:
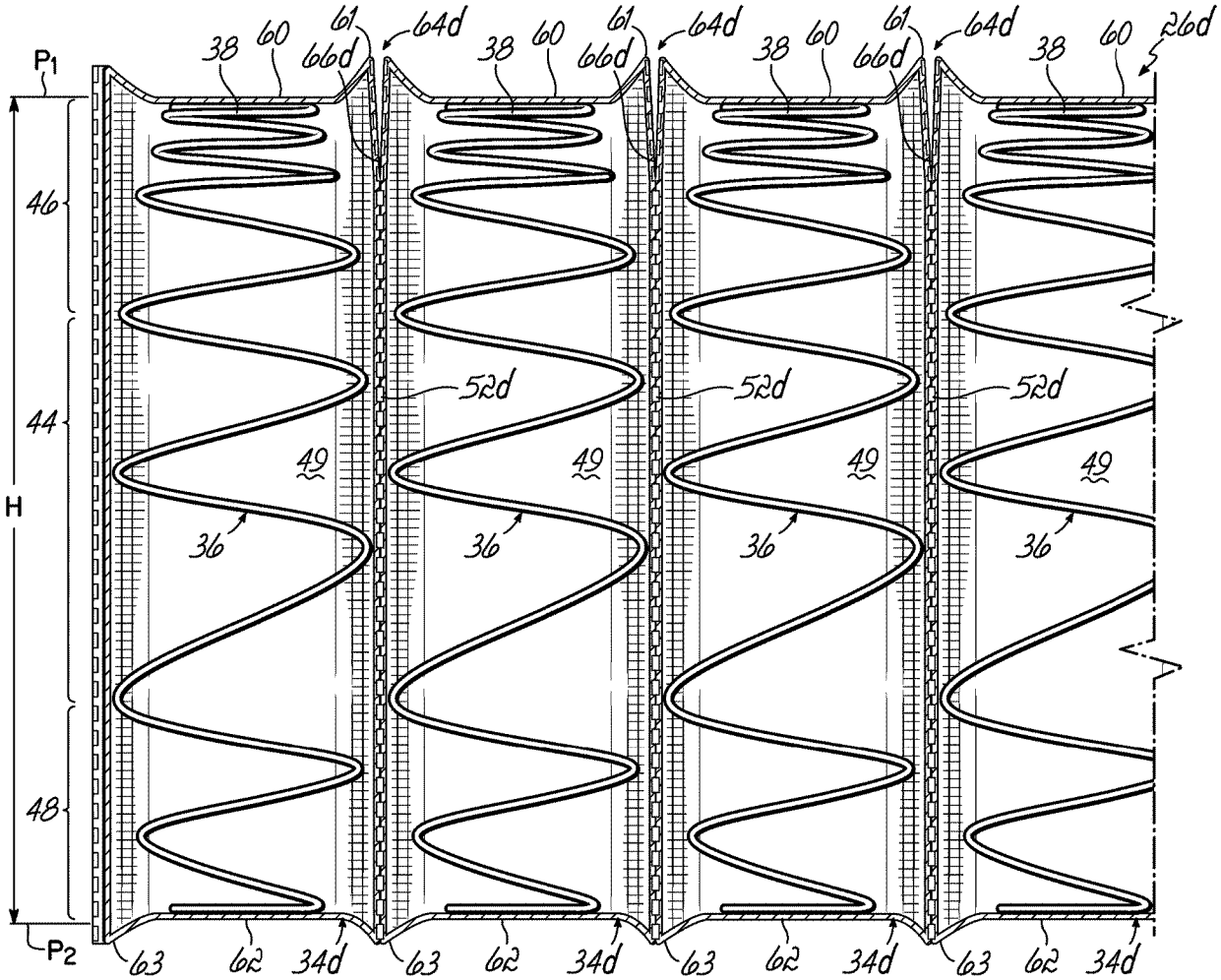
FIG. 10A is a cross-sectional view, partially broken away, of the string of springs of FIG. 9 in an unloaded condition.
Figure 10B:
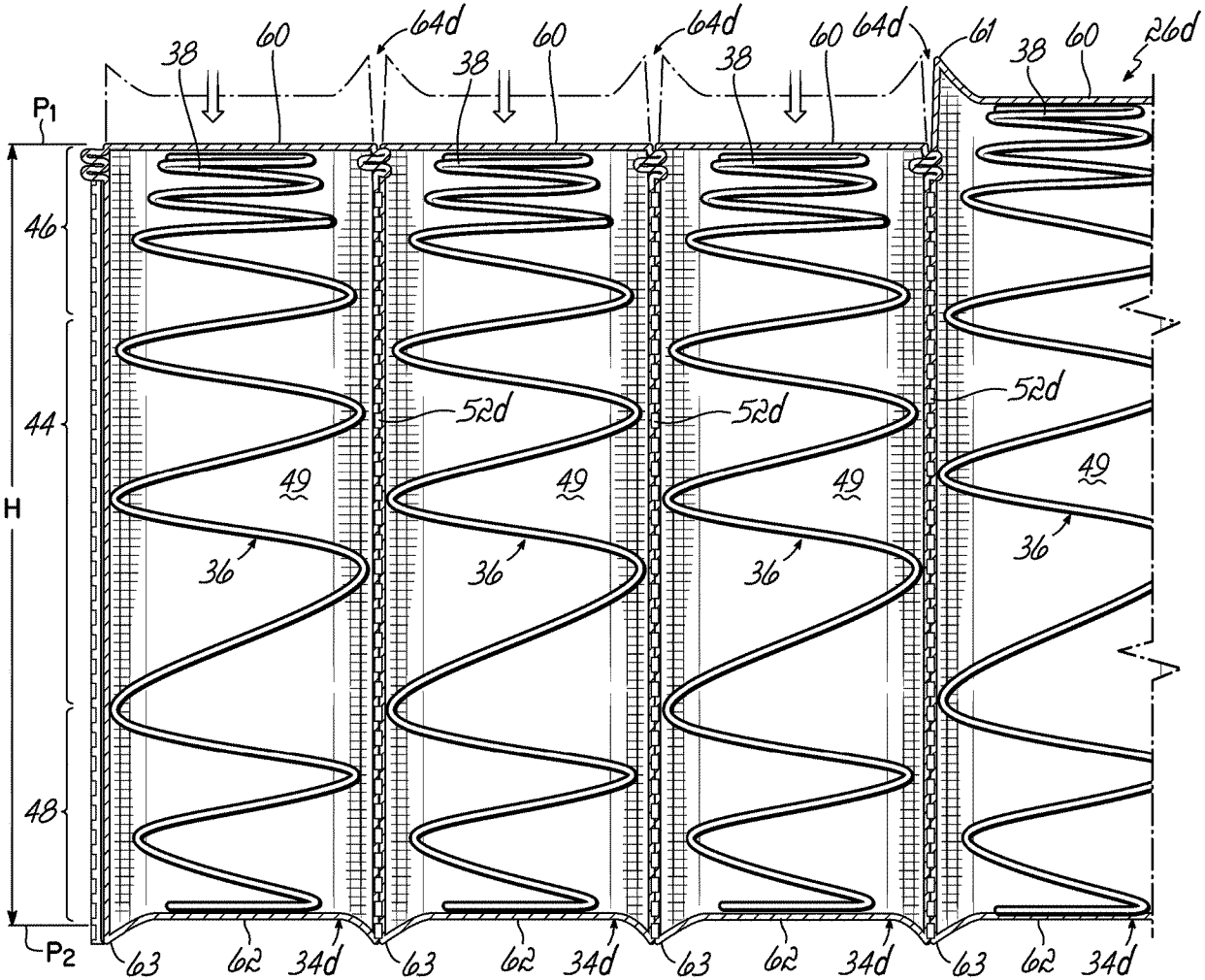
FIG. 10B is a view similar to FIG. 10A, a portion of the string of FIG. 10A being in a loaded condition.

As best illustrated in FIGS. 9, 10A and 10B, each string 26*d* has identical springs 36 and components as the string 26 shown in FIGS. 2, 3A and 3B for a one-sided mattress or product. The one difference is that the transverse seams 52*d* of the string 26*d* each extend from the upper edge 61 of the string 26*d* to the lower edge 63 of the string 26*d*. As best shown in FIG. 10A, the fabric of the string 26*d* is bunched or raised above the upper surface 60 of the string 26*d* above the transverse seam 52*d* and extends below the lower surface 62 of the string 26*d*. Each transverse seam 52*d* is cut or otherwise treated to create a divide 64*d* extending from the upper edge 61 of the string 26*d* inwardly (downwardly as illustrated), so as to partially separate the adjacent pockets 34*d*.

In accordance with this embodiment, in strings 26*d*, the transverse seams 52*d* forming the adjacent pockets 34 are divided as at 64*d* to thereby form a cut, slit, or notch by, for example, cutting, slitting, severing, melting, or the like, from the upper surface 60 of the string of pocketed springs 26 inwardly (downwardly as illustrated), so as to partially separate the adjacent pockets 34. Preferably, the divide 64*d* extends beyond or below the upper end turn 38 of the spring 36. As best shown in FIGS. 9 and 10A, the divides 64*d* of transverse seams 52*d* of the strings 26*d* each have a lower end 66*d* located at the bottom of each divide 64*d*. As shown in FIG. 10A, the lower end 66*d* of each divide 64*d* is located below the upper end turn 38 and multiple convolutions of the upper end portion 46 of adjacent coil springs 36 when the coil springs 36 are not depressed as shown in FIG. 10B, enabling at least one end portion of the spring to compress without substantially compressing the middle portion of the spring, as shown in FIG. 10B. The configuration of the coil springs 36, in conjunction with the divides 64*d* of transverse seams 52*d* of the strings 26*d*, enable upper portions 46 of the coil springs 36 to compress upon being loaded without greatly affecting the performance of adjacent pocketed coil springs 36.

Figure 11A:
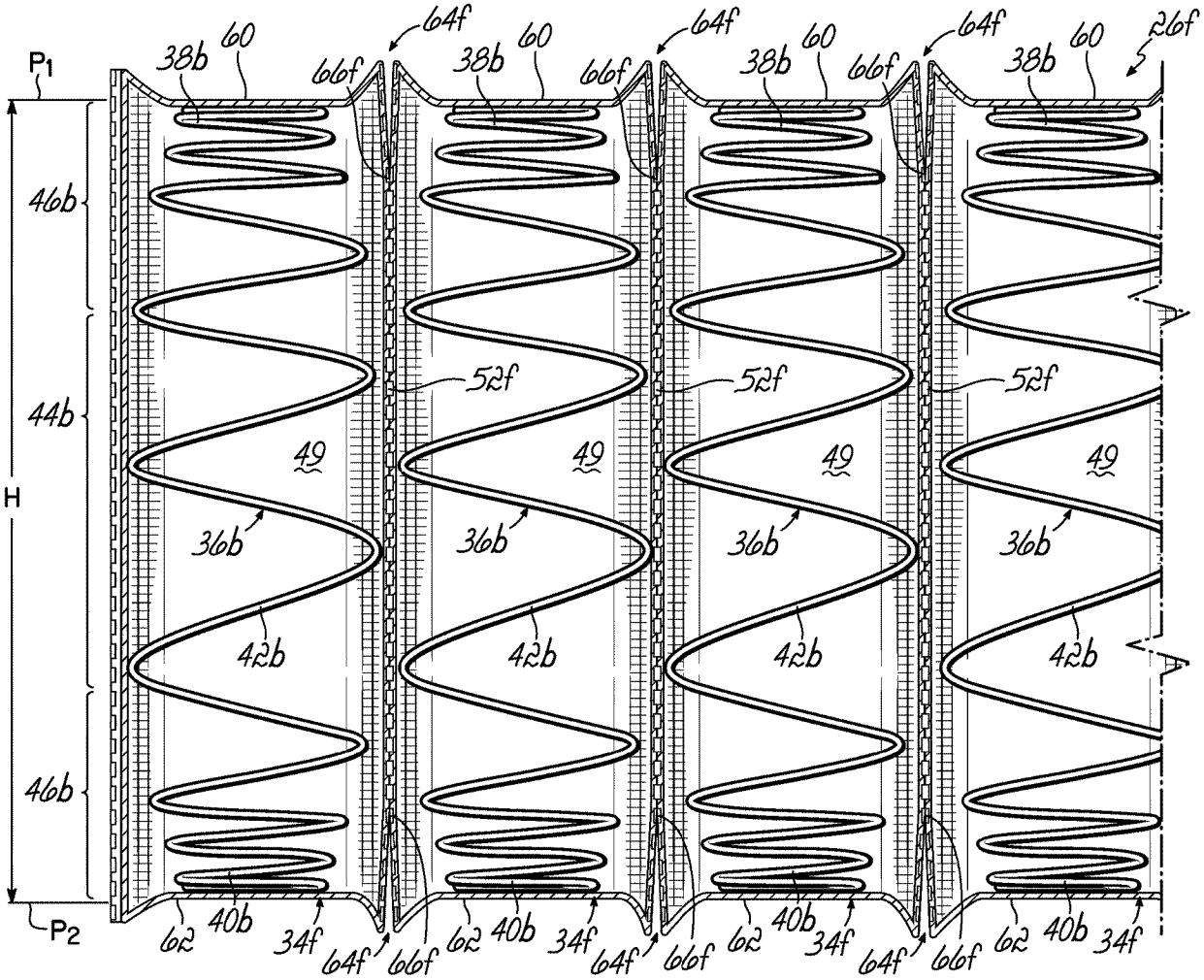
FIG. 11A is a cross-sectional view, partially broken away, of one of the strings of springs used in the product of FIG. 8B in an unloaded condition.
Figure 11B:
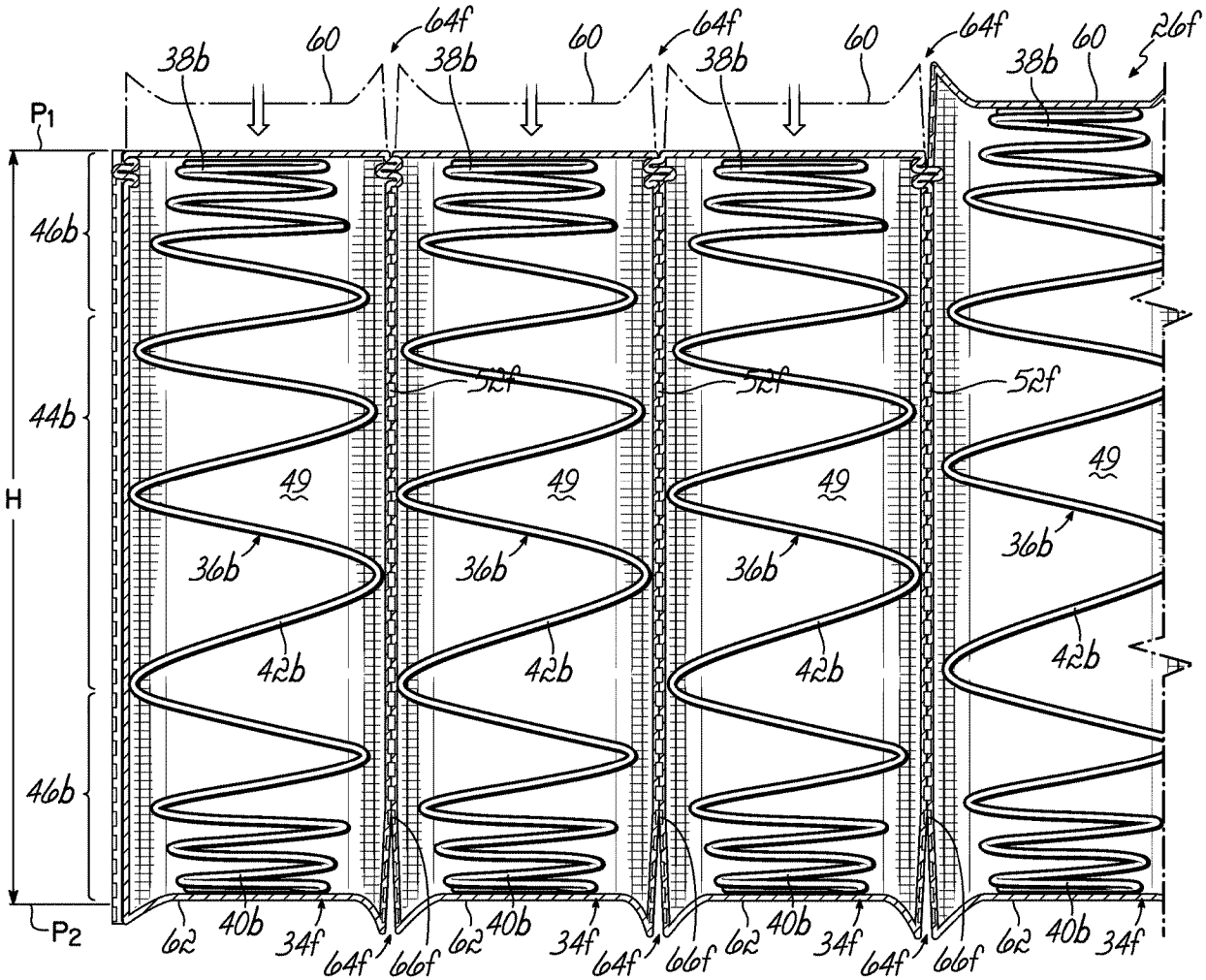
FIG. 11B is a view similar to FIG. 11A, a portion of the string of FIG. 11A being in a loaded condition.

FIGS. 11A and 11B illustrate a portion of a string of springs 26*f* used in a pocketed spring assembly 12*f* for a double-sided mattress, like mattress 10*f* shown in FIG. 8B. The fabric pockets 34*f* of such strings of springs 26*f* are slightly different than the fabric pockets 34 of string of springs 26. There are divides 64*f* along the tops and bottoms of the string of springs 26*f*. Additionally, the coil springs 36*b* are double-sided, different than the single-sided coil springs 36 shown in FIGS. 10A and 10B. Each coil double-sided coil spring 36*b* comprises a central or longitudinal axis A1, an upper end turn 38*b*, a lower end turn 40*b* and a plurality of central convolutions 42*b* between the end turns. FIGS. 8B, 11A and 11B illustrate a barrel-shaped coil spring 36*b* in which the diameter of the end turns 38*b*, 40*b* is less than the diameter of the central convolutions 42*b*, the central convolutions 42*b* tapering or decreasing in diameter and pitch as one moves from a center or middle portion 44*b* of the coil spring towards the end turns. As best shown in FIG. 11A, each barrel-shaped coil spring 36*b* has two identical end portions 46*b*.

In accordance with this embodiment, in strings 26*f*, the transverse seams 52*f* forming the adjacent pockets 34*f* are divided as at 64*f* at each end to thereby form two cuts, slits, or notches by, for example, cutting, slitting, severing, melting, or the like, from the upper edges 61, 63 of the transverse seam 52*f* of string 26*f* inwardly (downwardly and upwardly as illustrated), so as to partially separate the adjacent pockets 34*f*. Preferably, upper divide 64*f* extends beyond or below the upper end turn 38*b* of the spring 36*b*. As best shown in FIG. 11A, the upper divides 64*f* of transverse seams 52*f* of the strings 26*f* each have a lower end 66*f* located at the bottom of each divide 64*f*. As shown in FIG. 11A, the lower end 66*f* of each upper divide 64*f* is located below the upper end turn 38*b* and multiple convolutions of the upper end portion 46*b* of adjacent coil springs 36*b* when the coil springs 36*b* are in a preloaded condition shown in FIG. 11A enabling at least one end portion 46*b* of the spring 36*b* to compress without substantially compressing the middle portion 44*b* of the spring 36*b*, as shown in FIG. 11B. The configuration of the coil springs 36*b*, in conjunction with the divides 64*f* of transverse seams 52*f* of the strings 26*f* enable upper portions 46*b* of the coil springs 36*b* to compress upon being loaded without greatly affecting the performance of adjacent pocketed coil springs 36*b*.

Similarly, each lower divide 64*f* extends above the lower end turn 40*b* of the spring 36*b*. As best shown in FIG. 11A, the lower divides 64*f* of transverse seams 52*f* of the strings 26*f* each have an upper end 66*f* located at the top of each lower divide 64*f*. As shown in FIG. 11A, the upper end 66*f* of each lower divide 64*f* is located above the lower end turn 40*b* and multiple convolutions of the lower end portion 46*b* of adjacent coil springs 36*b* when the coil springs 36*b* are in a relaxed condition enabling at least one end portion 46*b* of the spring 36*b* to compress without substantially compressing the middle portion 44*b* of the spring 36*b*, as shown in FIG. 11B.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of any and all of those features. Accordingly, the scope of the invention shall be limited only by the following claims and their equivalents.

What is claimed is:

1. A bedding or seating product comprising: a pocketed spring assembly comprising a plurality of parallel strings of springs, each said string joined to an adjacent said string, each said string comprising first and second opposed plies of fabric and a plurality of pockets formed along a length of said string by transverse seams joining said first and second plies and at least one spring positioned in each said pocket; each of said springs having upper and lower end turns and a plurality of central convolutions between said end turns, the convolutions decreasing in diameter and pitch from a middle portion of the spring towards at least one of the end turns, wherein each of said transverse seams forming said adjacent pockets of said string is cut to create at least one divide between adjacent springs enabling at least one end portion of the spring to compress without substantially compressing the middle portion of the spring, each of said transverse seems having an upper end and wherein the upper end turn and multiple convolutions of each of said springs are above the upper ends of adjacent transverse seams when each spring is in a relaxed state; cushioning materials; and an upholstered covering encasing said pocketed spring assembly and cushioning materials.

2. A bedding or seating product comprising: a pocketed spring assembly comprising a plurality of parallel strings of springs, each said string joined to an adjacent said string, each said string comprising first and second opposed plies of fabric and a plurality of pockets formed along a length of said string by transverse seams joining said first and second plies, and at least one spring positioned in each said pocket; each of said springs having upper and lower end turns and a plurality of central convolutions between said end turns, the convolutions decreasing in diameter and pitch from a middle portion of the spring towards at least one of the end turns, wherein each of said transverse seams forming said adjacent pockets of said string is cut treated to create at least one divide between adjacent springs enabling at least one end portion of the spring to compress without substantially compressing the middle portion of the spring, each of said transverse seems having an upper end and wherein the upper end turn and multiple convolutions of each of said springs are above the upper ends of adjacent transverse seams when each spring is in a relaxed state.

3. The product of claim 2 wherein the strings of springs extend longitudinally.

4. The product of claim 2 wherein the strings of springs extend transversely.

5. The product of claim 2 wherein each of said springs is made of one piece of wire.

6. The product of claim 2 wherein each of the springs has a uniform diameter.

7. The product of claim 2 wherein each of the springs has end portions and said middle portion, the convolutions of the middle portion having a greater diameter and greater pitch than the convolutions of at least one of the end portions.

8. A pocketed spring assembly for a bedding or seating product, said pocketed spring assembly comprising: a plurality of parallel strings of springs, each of the strings being joined to an adjacent string of springs, each of the strings comprising a plurality of interconnected pockets, each of the pockets containing at least one spring encased in fabric, the fabric being joined to itself along a longitudinal seam and having first and second opposed plies of fabric on opposite sides of the springs, the fabric of said first and second plies being joined by transverse seams, each transverse seam having an upper end, each of said springs having upper and lower end turns and a plurality of central convolutions between said end turns, the spring having two end portions and a middle portion between the end portions, the convolutions of the middle portion being greater in diameter and pitch than the convolutions of at least one of the end portions of the spring, wherein each of said transverse seams forming adjacent pockets of said string has a divide formed by a cut in the transverse seam between adjacent springs having one end located below an upper surface of said string so as to allow at least one end portion of the spring to compress upon being subjected to a load, wherein the upper end turn and multiple convolutions of each of said springs are above the upper end of adjacent transverse seams when each spring is in a relaxed state.

9. The spring assembly of claim 8 wherein said strings of springs extend longitudinally.

10. The spring assembly of claim 8 wherein said strings of springs extend transversely.

11. The spring assembly of claim 8 wherein each of said springs is made of one piece of wire.

12. The spring assembly of claim 8 wherein one of the end portions of the spring has more convolutions than the other end portion of the spring.

13. A pocketed spring assembly for a bedding or seating product, said pocketed spring assembly comprising: a plurality of parallel strings of springs, each of the strings being joined to an adjacent string of springs, each of the strings comprising a plurality of interconnected pockets, each of the pockets containing at least one spring encased in fabric, the fabric being joined to itself along a longitudinal seam and having first and second opposed plies of fabric on opposite sides of the springs, the fabric of said first and second plies being joined by transverse seams each transverse seam having an upper end, each of said springs having two end portions and a middle portion between the end portions, convolutions of the middle portion being greater in diameter and pitch than convolutions of at least one of the end portions of the spring, wherein each of said transverse seams forming adjacent pockets of said string has a divide formed by a cut in the transverse seam between adjacent springs having an end located below an upper surface of said string so as to partially separate said adjacent pockets and enable an upper end portion of the spring to compress without substantially compressing the middle portion of the spring; each of said springs having upper and lower end turns and a plurality of central convolutions between said end turns, wherein the upper end turn and multiple convolutions of each of said springs are above the upper ends of adjacent transverse seams when each spring is in a relaxed state.

14. The spring assembly of claim 13 wherein said strings of springs extend longitudinally.

15. The spring assembly of claim 13 wherein said strings of springs extend transversely.

16. The spring assembly of claim 13 wherein the longitudinal seam of each of said strings of springs is located along one of the sides of the string of springs.

17. The spring assembly of claim 13 wherein one of the end portions of the spring has more convolutions than the other end portion of the spring.

* * * * *